United States Patent [19]

Sato

[11] 4,084,507

[45] Apr. 18, 1978

[54] PRINTING DEVICE FOR PORTABLE LABEL PRINTING MACHINE

[75] Inventor: Yo Sato, Tokyo, Japan

[73] Assignee: Kabushiki Kaisha Sato Kenkyusho, Tokyo, Japan

[21] Appl. No.: 704,443

[22] Filed: Jul. 12, 1976

[30] Foreign Application Priority Data

Jul. 15, 1975 Japan ..... 50-85869

[51] Int. Cl.[2] ..... B41J 1/32

[52] U.S. Cl. ..... 101/110; 101/111

[58] Field of Search ..... 101/110, 111, 95-101

[56] References Cited

U.S. PATENT DOCUMENTS

| | | | |
|---|---|---|---|
| 940,186 | 11/1909 | Otteson | 101/110 X |
| 1,188,828 | 6/1916 | Putnam et al. | 101/110 |
| 2,351,281 | 6/1944 | Nachemov | 101/110 |
| 3,363,547 | 1/1968 | Thut et al. | 101/110 X |
| 3,750,565 | 8/1973 | Hubbard | 101/111 X |
| 3,968,745 | 7/1976 | Hamisch | 101/111 |
| 3,972,281 | 8/1976 | Sams | 101/110 |

*Primary Examiner*—Edward M. Coven
*Attorney, Agent, or Firm*—Ostrolink, Faber, Gerb & Soffen

[57] ABSTRACT

A printing device for a portable label printing machine: The printing device is of the type in which the indicating wheels that both choose the types to be printed and that indicate the chosen types are arranged in a row on a common axis and the type wheels that carry the types to be printed and that are connected with the indicating wheels to be moved thereby are also arranged on another common axis and all of the wheels are located between side frames of the printing device; an indexing shaft having a selector knob is slid along the axis of and through the indicating wheels; the indexing shaft carries a pinion which engages the interior of the selected indicating wheel to rotate that wheel; the indicating wheels are supported around their peripheries in a blind hole formed in one of the side frames.

In a modified embodiment, the axially slidable indexing shaft that rotates the indicating wheels and the selector knob for rotating the indexing shaft are automatically moved into the body of the printing device after type selection; the indexing shaft comprises a hollow tubular body, the hollow portion of which is provided with a spring mechanism so as to urge the indexing shaft into the indicating wheels.

14 Claims, 22 Drawing Figures

PRINTING DEVICE FOR PORTABLE LABEL PRINTING MACHINE

BACKGROUND OF THE INVENTION

Description of the Prior Art

This invention relates to a printing device which can be mounted on a portable label printing and applying machine, a price tag printing and attaching machine, or the like.

More particularly, the invention relates to a printing device in which a plurality of type wheels are arranged side-by-side on a common axis and a plurality of indicating wheels, each corresponding to, paired with and in engagement with a respective type wheel, are arranged side-by-side on a second common axis. The arrays of type and indicating wheels are supported in the space between a frame comprised of a pair of side frames. An indexing shaft, having a selector knob projecting from one of the side frames, extends along the direction of the aligned axes of the indicating wheels. The indexing shaft is slid along the axes of the indicating wheels so as to select and engage a particular indicating wheel. Upon rotation of the indexing shaft, the selected indicating wheel and the corresponding type wheel are rotated to a particular print position.

Many devices of the described type are in use. See, for example, U.S. application Ser. No. 658,491, filed Feb. 17, 1976 and 678,761, filed Apr. 21, 1976. One example of such a printing device from the prior art is described in the description below of a preferred embodiment.

In one prior arrangement, the indexing shaft passes through a supporting sleeve. The shaft has a pinion attached on it. The teeth of the pinion engage and rotate each selected indicating wheel. The supporting sleeve has axial grooves to permit the pinion teeth to project through and to engage the indicating wheels. Necessarily, the rotation of the indexing shaft correspondingly rotates the sleeve through which the pinion teeth project.

Forming the sleeve to be strong enough to support the shaft limits the number of axial grooves the sleeve may have. This, in turn, limits the number of teeth on the pinion. A smaller number of teeth are each under greater stress and are more likely to be damaged through use. Also, axial shifting of the indexing shaft through the indicating wheels to bring the pinion to a particular indicating wheel is inhibited by friction between the indexing shaft and the sleeve. Further, rotation of the indexing shaft to rotate the pinion together with the sleeve is inhibited because the sleeve rubs and is frictionally retarded by its contact with all of the indicating wheels not then being rotated by the pinion.

Once the indexing shaft has been rotated to rotate the pinion and the corresponding indicating wheel, the shaft and its operating knob are projecting out of the side frame. Especially when the indicating wheel that has been rotated is near to the side frame from which the indexing shaft projects, the shaft is projecting out quite far and is liable to be bent or damaged by or to cause damage by contacting other objects, by the labeler being dropped, etc. It is desirable to shift the shaft away from such a vulnerable position.

In order to avoid the above mentioned problem, operators must always move the indexing shaft and its knob fully into the printing device by axially pushing the selector knob into the printing device after completion of type selection. However, operators often forget to push in the selector knob and thus the projecting indexing shaft is sometimes damaged.

BRIEF SUMMARY OF THE INVENTION

The primary object of the present invention is to provide an improved printing device which eases the selection of types to be printed.

It is another object of the invention to ease the rotation of the indicating wheels that both indicate the types to be printed and rotate the type wheels carrying the types.

It is a further object of the invention to ease the axial shifting of the indexing shaft of the indicating wheels.

It is yet another object of the invention to simplify the structure and manufacture of a printing device.

It is still another object of the present invention to provide a printing device in which those elements that cause selection of the types to be printed, including the indexing shaft, the selector knob, and other elements associated with or connected to these, are protected against damaging contact with other objects.

It is another object of the invention that the type moving elements automatically slide into the body of printing device after the selection of types.

The printing device of the present invention is of the kind described above. Manipulation of a selector knob selectively rotates one of the indicating wheels and its corresponding type wheel so as to move a selected type formed on the selected type wheel to a printing position.

In the present invention, one of the side frames of the frame of the printing device has a blind hole formed in it to receive the indicating wheels in a side-by-side array. A window is formed in the upper portion of that side frame. Indicia on the indicating wheel are visible through the window. An opening is formed on the lower side of that side frame for enabling engagement between the indicating wheels and the types which are supported on the type wheels. The indicating wheels have external gear teeth around their peripheries. The peripheries of the indicating wheels, and particularly the tooth crests of the external gear teeth, are in contact with and are supported for rotation by the inner wall of the blind hole. The teeth of each indicating wheel are also in engagement through the opening at the bottom side of the blind hole with corresponding teeth on the respective type wheel.

The indexing shaft is supported by and projects through one side frame of the printing device. The shaft has a profiled, toothed or involutely curved pinion at its free end. There are indexing grooves spaced axially along the middle portion of the indexing shaft. An indicating member to indicate which indicating wheel the pinion is engaging is connected to move with the indexing shaft. A selector knob is attached to the end portion of the indexing shaft that projects outside the one side frame.

Each indicating wheel has an opening through its center which is defined by a profiled, toothed or involutedly curved side wall. The pinion on the indexing shaft is similarly shaped to but not quite as large in the cross section as the opening through the indicating wheel. This leaves a small space between the involute curves of the internal gear teeth of the indicating wheels and the external teeth of the pinion. Thus, the pinion can pass freely through the opening through every indicating wheel when the pinion and the indicating wheel are in selected respective rotative positions such that their curved profiles are generally shaped. The pinion engages only the single indicating wheel that the pinion happens to be inside when the pinion is rotated. Then the teeth of the pinion and the internal gear teeth of that indicating wheel engage through rotation of the selector knob.

The indexing shaft is slid by its selector knob along the common axis of the indicating wheels to move the pinion into engagement with the internal gear teeth of a selected indicating wheel. Then the type wheel which is in engagement with the selected indicating wheel is rotated, thereby moving a desired type on the type wheel to the printing position.

In a modified embodiment of the invention, after the indexing shaft and the selector knob have been moved along the direction of the axis of the indicating wheels and the selected indicating wheel has been rotated, they are automatically drawn by appropriate biasing means toward the body of the printing device so as not to obstruct the operation of label application, thereby preventing damage caused by the projecting indexing shaft.

In one version, a hollow tubular indexing shaft is used. The hollow in the indexing shaft has a spring device in it which always urges the indexing shaft into the printing device and through all of the aligned internal gear teeth of the indicating wheels.

BRIEF DESCRIPTION OF THE DRAWINGS

In order that the invention may be more fully understood, preferred embodiments are now described with reference to the accompanying drawings, in which.

DETAILED DESCRIPTION OF AN EMBODIMENT OF THE PRIOR ART

Figure 11:
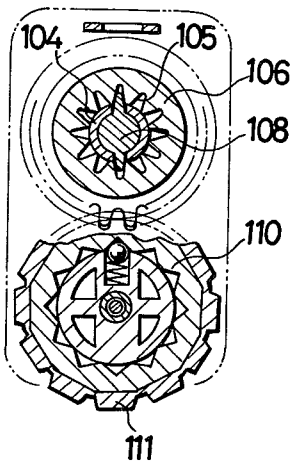
FIG.11 PRIOR ART
FIG. 11 is a cross-sectional view of the prior art printing device taken along the line XI—XI in FIG. 10.
Figure 10:
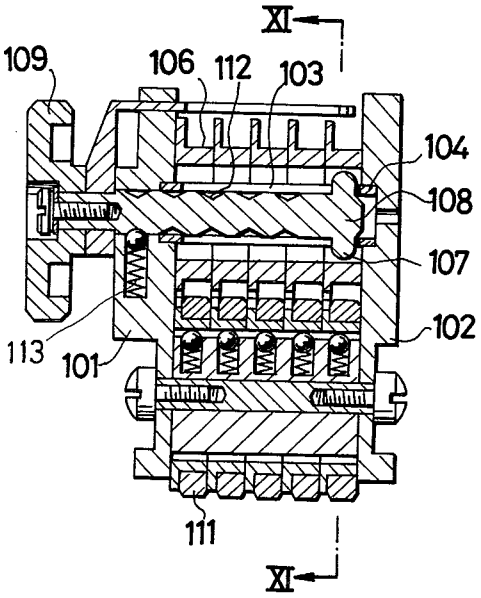
FIG.10 PRIOR ART
FIG. 10 is a central cross-sectional view of a printing device in the prior art.

Refer to FIGS. 10 and 11. There is a pair of side frames 101 and 102. A tubular sleeve 104 extends across the space between and is attached to these frames. Sleeve 104 has elongated longitudinally extending grooves 103 defined in it. A plurality of indicating wheels 106 are arranged side-by-side and axially aligned between frames 101 and 102. Each wheel 106 has internal gear teeth 105. Wheels 106 are fitted over the outer surface of the sleeve 104. Appropriate detent means keep the internal gear teeth of the wheels 106 axially aligned to permit axial shifting of below described indexing shaft 108.

An elongated indexing shaft 108 is inserted through the inner bore of the sleeve 104. The indexing shaft 108 has one or two radial projections 107 located at its tip end. The projections 107 have an axial length no greater than that of an indicating wheel 106. The projections pass through grooves 103 of sleeve 104. Rotation of shaft 108 thus rotates sleeve 104. The projections 107 are guided for axial motion by the elongated grooves 103. The projections 107 extend into engagement with the internal gear teeth 105 of the indicating wheel 106 in which the projections are then positioned. The indexing shaft 108 has a selector knob 109 at its end. The shaft 108 is slid axially through the array of indicating wheels 106 so as to position projections 107 in a desired indicating wheel 106. The selector knob 109 is then rotated and this rotates the selected indicating wheel 106 by the engagement between the projections 107 and gear teeth 105.

A corresponding type wheel 110 is in engagement with the selected rotated indicating wheel 106. Rotation of wheel 106 rotates the type wheel 110 and thereby selects a desired type 111.

In the above described prior art printing device, when the indexing shaft 108 is slid through the inner bore of the sleeve 104, there is friction between the outer surface of the indexing shaft 108 and the inner surface of the sleeve 104. As a result, it is difficult to move the indexing shaft 108 axially. In addition, the radially inwardly projecting tooth crests of internal gear teeth 105 of the other indicating wheels 106 that are not in engagement with the projections 107 are in contact with the outer surface of the sleeve 104. The rotation of the selector knob 109 and shaft 108 to select a type is retarded because there is resistance to rotation of the sleeve 104.

Furthermore, the indexing shaft 108 has axially spaced apart, narrow cross-section, annular indexing grooves 112 which are engaged by a detent means 113. The spacing of grooves 112 positions projections 107 only wholly within a wheel 106. The grooves 112 increase the resistance to the sliding movement of the indexing shaft 108. The indexing shaft 108 is liable to be broken.

Still further, since the number of projections 107 is usually restricted to one or two, the projections 107 are often damaged by wear or rough handling. In addition, to impart strength to the sleeve 104, it is made from stainless steel pipe, or the like, which is expensive and inexpedient for mass production.

DETAILED DESCRIPTION OF A FIRST PREFERRED EMBODIMENT

Referring to FIGS. 1–9, a first preferred embodiment of the printing device of the present invention is described. The printing device includes a pair of spaced apart side frames 1 and 2. The side frame 1 integrally supports on one side a side frame body 4 having a circular blind hole 3 formed in it (FIG. 4) that extends at least the axial length of the below described array of indicating wheels 7. Hole 3 is defined by its inside wall 39. There are recesses (not shown) formed in the inside face of the other side frame 2 to receive the projections 5 and 6 formed on the frame body 4 and to properly orient the side frames with respect to each other. The side frame 2 is secured to the frame body 4 by means of respective set screws (not shown). At the upper end of the blind hole 3, there is an indicating window 8, through which several rows of indicia 37 formed on the peripheral surfaces of indicating wheels 7 may be observed. At the lower end of the blind hole 3, there is a large opening 12, through which the external gear teeth 9 of the indicating wheels 7 communicate with the external gear teeth 11 of type wheels 10.

A plurality of same size indicating wheels 7, each carrying visible indicia 37 that correspond to respective types on the corresponding type wheels, are arranged side-by-side on a common axis in the blind hole 3. The indicating wheels 7 each have external, outwardly projecting gear teeth 9 with outer ends or crests 38. All the indicating wheels 7 are supported by the engagement between the tooth crests 38 of the external gear teeth 9 of indicating wheels 7 and the inside wall 39 of the blind hole 3. Therefore, the indicating wheels 7 can be rotated easily with negligible frictional resistance.

A central opening is formed in each indicating wheel 7. The opening is surrounded by and defined by gear teeth 25, which are in the illustrated form of involute curves. All central openings are of the same shape and size. By means described below, except when an indicating wheel 7 is being rotated, all of the gear teeth of all of wheels 7 are aligned axially.

A wider bearing hole 13 is bored in side frame 1 and a narrower through hole 14 is bored in the other side frame 2. The holes 13 and 14 are concentric with the much wider blind hole 3. Aligned holes 22 and 23 are formed in the lower parts of the frames 1 and 2 for receiving a supporting shaft 19. Shaft 19 is secured at the holes 22 and 23 with the respective screws 20 and 21. The shaft 19 passes through and carries a large diameter supporting drum 18 for the type wheels 10.

Figure 1:
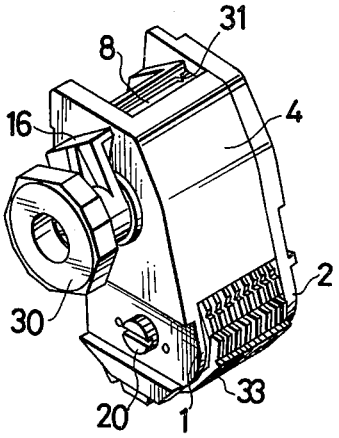
FIG. 1 is a perspective view of one preferred embodiment of printing device of the present invention.
Figure 2:
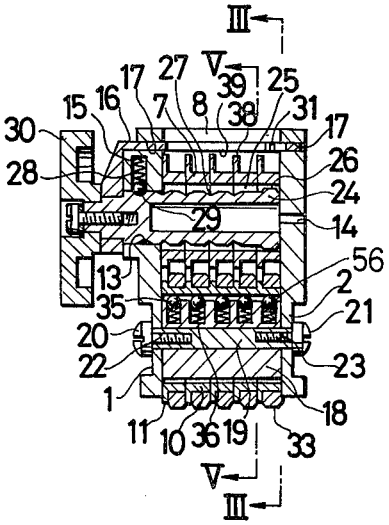
FIG. 2 is a cross-sectional view of the first embodiment of the printing device taken along the line II—II in FIG. 3.
Figure 3:
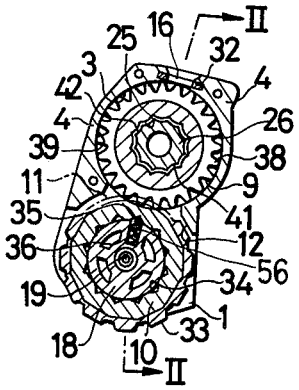
FIG. 3 is a cross-sectional view of the first embodiment of the printing device taken along the line III—III in FIG. 2.
Figure 5:
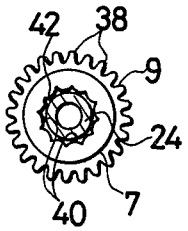
FIG. 5 is a side view partially in cross-section of parts of the printing device, namely an indicating wheel and an indexing shaft taken along the line V—V in FIG. 2.
Figure 4:
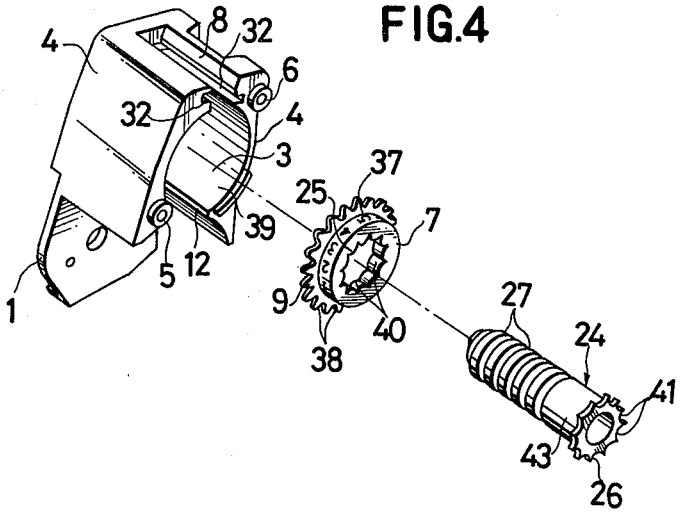
FIG. 4 is an exploded perspective view showing parts of the printing device, namely the side frame having a blind hole, an indicating wheel and an indexing shaft.

As shown at the left in FIGS. 2 and 4, an indexing shaft 24 passes through and is supported by the wall of the side frame 1 surrounding bearing hole 13. The indexing shaft 24 is inserted through the central openings in the aligned indicating wheels 7. The indexing shaft 24 and the central openings through wheels 7 are shaped and sized so as to leave a clearance space 42 (FIGS. 7 and 8) between the outer surface 43 of shaft 24 and the internal gear teeth 25 of indicating wheels 7.

Along the middle portion of the indexing shaft 24, a plurality of axially spaced, annular indexing grooves 27 are formed. They are spaced apart the same distance as the indicating wheels 7.

Figure 7:
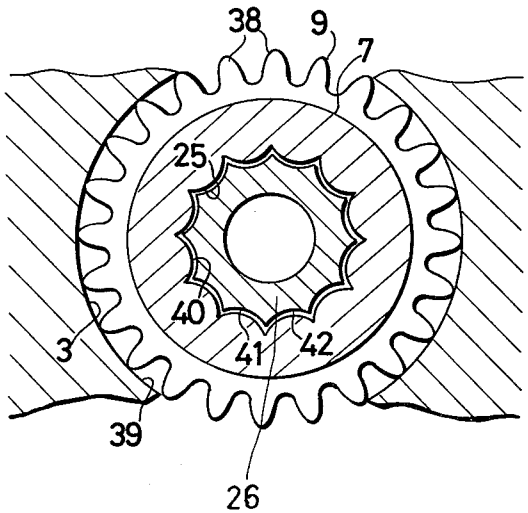
FIG. 7 is an enlarged cross-sectional view of the upper main part of FIG. 3 in one operative condition.

As shown in FIGS. 2, 4 and 7, a toothed pinion 26 is formed at the free end of the indexing shaft 24. The involute curves 41 of the teeth of the pinion 26 are correspondingly shaped to and are positioned in the corresponding involute curves 40 of the internal gear teeth 25 of an indicating wheel 7. The shaping of pinion 26 and all gear teeth 25 is such as to leave the small space 42 (FIG. 7) between the gear teeth 25, 41 before the gear teeth 25, 41 are engaged together (engagement shown in FIG. 9).

The side frame 1 has a small blind hole 15 which is perpendicular to and extends away from the bearing hole 13. A steel ball 29 is held in the blind hole 15. Ball 29 is urged out of hole 15 by a helical spring 28 behind the ball. The shaft 24 is axially shiftable through the indicating wheels 7. The steel ball 29 is brought into engagement with the indexing groove 27 on the indexing shaft 24 that is then beneath hole 15. By appropriate placement of hole 15 with respect to grooves 27, axial positioning of the pinion 26 wholly inside only one indicating wheel at a time is attained.

Square shaped apertures 17 are formed in the side frames 1 and 2 for receiving an indicating member 16. The indicating member 16 is rotatably supported on and axially affixed on the end of the indexing shaft 24 which projects from the side frame 1. Thus, the indicating member 16 shifts axially with the shaft 24, but the shaft is able to rotate while the member 16 does not rotate. The indicating member passes through and is thus restrained from rotation by the apertures 17 in the side frame 1.

At the outside of the indicating member 16, the indexing shaft 24 is provided with a selector knob 30. When the selector knob 30 is moved in the axial direction of the indexing shaft 24, the shaft is moved together with the indicating member 16 so as to move the pinion 26 into a selected indicating wheel 7. The shaft 24 is then rotated about its axis by the selector knob 30 until a selected indicium on the wheel 7 appears at the window 8.

One side edge of the indicating member 16 is provided with an arrow 31 that is axially aligned with the pinion 26. Arrow 31 points to the indicating wheel 7 whose indicia are to be selected and in which the pinion 26 is engageable with the internal gear teeth 25. The indicating member 16 is guided by the grooves 32 of the frame body 4 and thus it is slidable across the indicating window 8.

There is a set of types 33 connected to move with each indicating wheel and movable to shift a different type to a print position as the indicating wheel rotates. Each set of types is associated with a type wheel 10, which is, in turn, associated with each indicating wheel 7. Each type wheel is provided on its periphery with a series of types 33 to be printed. Alternatively, a stamp belt carrying the series of types to be printed is wrapped about the type wheel and its corresponding indicating wheel or about the type wheel alone. Each type wheel has an enlarged diameter opening through its center, which is defined by a toothed or plural recessed side wall having recesses 34 in it. The number of recesses 34 corresponds to the number of imprinting types 33 on type wheel 10, and each recess 34 is so placed with respect to its corresponding type 33 as to assure each type will only stop with precision at its print position.

As shown in FIG. 2, adjacent to the series of types on each type wheel 10 are the external peripheral gear teeth 11, which are shaped, spaced and positioned to be in continuous meshing engagement with the external gear teeth 9, 38 of the corresponding indicating wheel. The opening 12 at the bottom of the side frame 4 and side wall 39 provides access for this engagement. Rotation of an indicating wheel 7 causes corresponding rotation of the respective type wheel 10.

There is a device for establishing the rotative position of each type wheel to assure that it stops only at a discrete position with a type at a print position. This device comprises detent means for properly positioning each type wheel only at print positions. On the periphery of supporting drum 18 is defined a series of blind holes 56, each placed to be within a respective type wheel 10. In each blind hole 56 is a steel ball 35 which is urged out of the hole by the helical spring 36 and into engagement with a recess 34. The rotational positioning of each type wheel 10 so that a type on or supported thereby is securely in a print position is accomplished by the engagement of one of the steel balls 35 with one of the recesses 34 of the type wheel 10. It is apparent that the positions of the recesses 34 of a type wheel with respect to its types 33 and with respect to its ball 35 are selected so that that wheel is positioned with a type in the print position. Concurrently with this positioning of type wheel 10, the involute curves 40 of the internal gear teeth 25 of the corresponding indicating wheel 7 are aligned in parallel to the axis of the indexing shaft 24 and are aligned with each other along the axis of shaft 24. Thus, the same shaped space 42 is formed between the involute curves 41 of the pinion 26 and the interior of every wheel 7, as shown in FIG. 7. The orientations of all of the indicating wheels are related such that the involute curves 40 of internal gear teeth 25 of all indicating wheels 7 are all aligned, creating a common, aligned, axially elongated free space 42. Because of the existence of the aligned free spaces 42 in wheels 7, the pinion 26 can be easily moved through the aligned spaces 42 along the axis of the indexing shaft 24 through axial shifting of that shaft with almost no frictional resistance. Axial shifting of shaft 24 is deterred only by the resistance to its motion caused by the spring actuated ball 29 engaging an indexing groove 27 and the force of spring 28 having to be overcome. The pinion 26 can be accurately axially shifted to be in mesh with the internal gear teeth 25 of only one indicating wheel 7 because of the certain positioning resulting from the steel ball 29 being in a respective indexing groove 27.

To select a desired type on a particular type wheel, knob 30 is axially shifted until the arrow 31 of the indicating member 16 points to that indicating wheel which is then in engagement with the type wheel to be rotated. The corresponding pinion 26 is thereby shifted into the internal gear teeth 25 of the indicating wheel 7 to be rotated. The involute curves 41 around the pinion 26 and the involute curves 40 of internal gear teeth 25 of the indicating wheel 7 still have not contacted each other, leaving the space 42 (FIG. 7).

Figure 9:
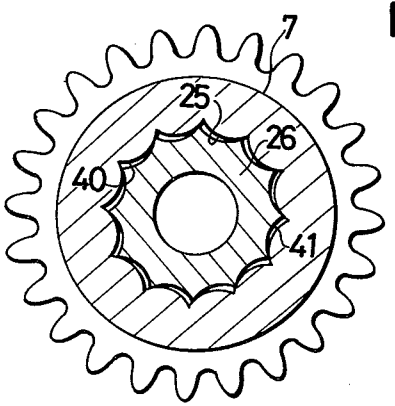
FIG. 9 is also an enlarged cross-sectional view of a fragment of FIG. 7 showing the elements in a different operative condition.

Next, as shown in FIG. 9, the selector knob 30 is rotated. This causes the pinion to close the space 42 to engage the curves 40 of gear teeth 25 and to rotate the selected indicating wheel 7, which is in engagement with the gear teeth of the pinion 26, until a desired indicium 37 appears at the indicating window 8. Because of the connection between the selected indicating wheel 7 and its type wheel, the type 33 on the type wheel 10, which corresponds to the viewable indicium at window 8, is moved to the print position.

In the foregoing type selection operation, because the indicating wheels 7 are held within the blind hole 3 and wheels 7 are supported by the contact between the tooth crests 38 of external gear teeth 9 of the indicating wheels 7 and the inside wall 39 of the hole 3, as shown in FIGS. 2 and 7, the selected indicating wheel 7 can be rotated without difficulty. Further, because the steel ball 35 is urged into all of the recesses 34 of the type wheel 10, in turn, the types 33 on the type wheel 10 can be stopped at their proper position. With this action, the indicating wheel 7 is also stopped at its proper position.

Figure 12:
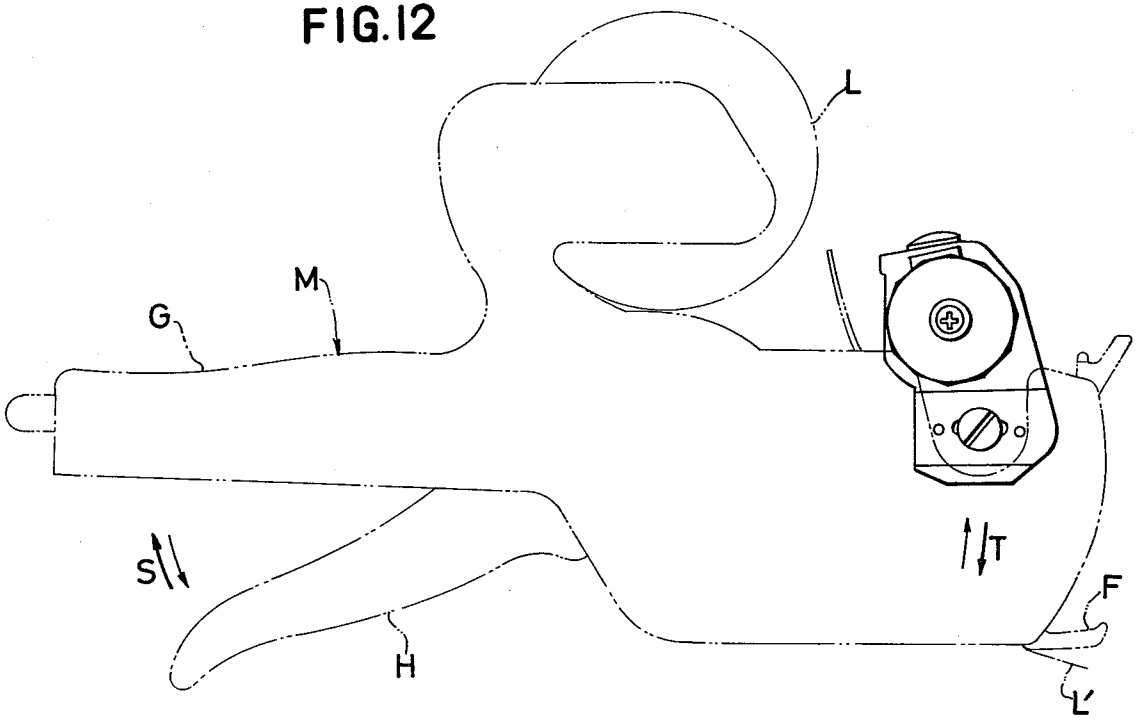
FIG. 12 is a schematic side elevation view of a label printing and applying machine which may be provided with any of the embodiments of the printing device of the present invention.
Figure 14:
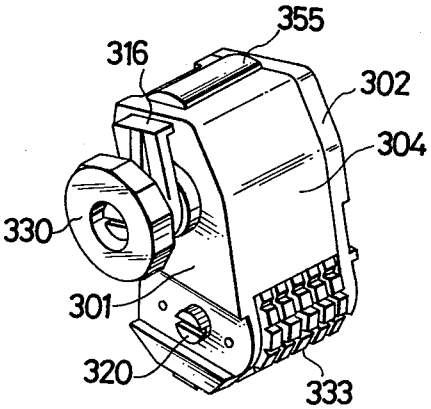
FIG. 14 is a perspective view of a second preferred embodiment of the printing device of the present invention.
Figure 13:
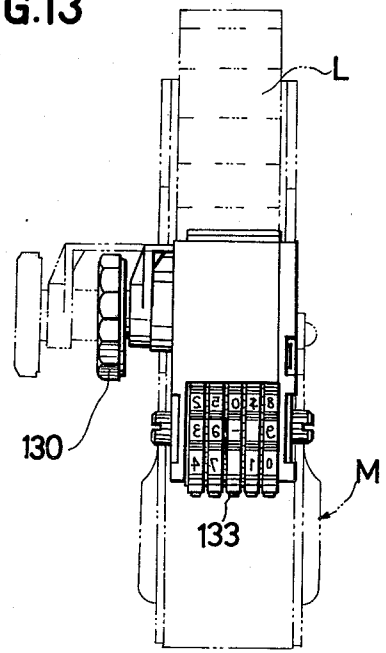
FIG. 13 is a front elevation view of the label printing and applying machine of FIG. 12.

The first embodiment, and any other embodiment also, of the printing device is mounted in a portable label printing and applying machine M, for example, that shown in FIGS. 12 and 13 and in U.S. Pat. No. Re. 27, 889. In this label printing machine, an adhesive-coated label L is printed with the printing device. The printing is accomplished by squeezing the grip G toward the hand lever H in the direction of arrow S. At the same time, the printing device is moved down in the direction of arrow T and an adhesive-coated label L is printed by types 133. The printed label L′ is then paid out and applied in the applying section F. The label L′ is applied to the surface of an article by moving the label, which is still being held by the label printing machine, against the article by moving the label printing machine in a hammering motion. The printing device is not described in detail.

DETAILED DESCRIPTION OF A SECOND PREFERRED EMBODIMENT

Figure 6:
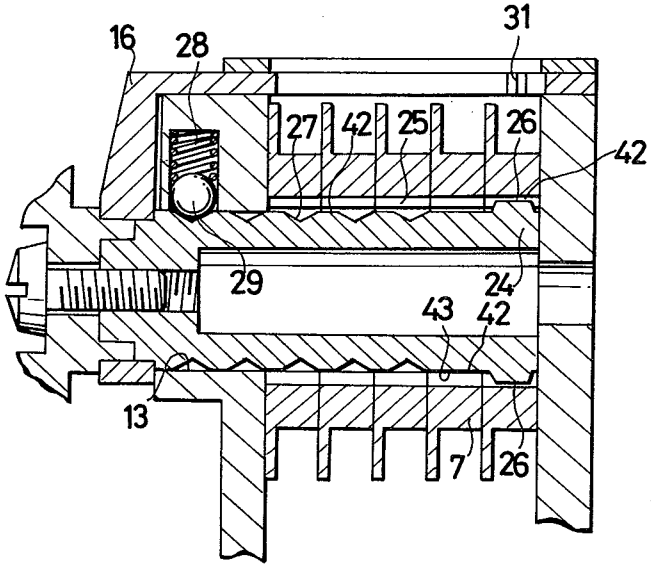
FIG. 6 is an enlarged cross-sectional view of the upper main part of FIG. 2.
Figure 8:
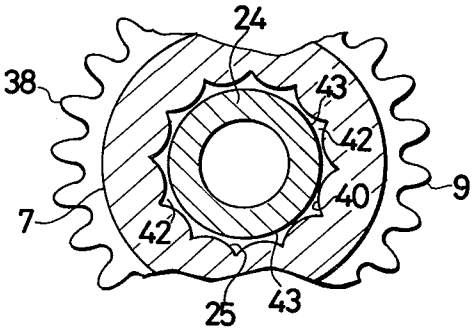
FIG. 8 is an enlarged cross-sectional view of the main part of FIG. 5.

In FIGS. 2 and 6, which is the illustrated selecting operation, the innermost type wheel 10 and indicating wheel 7, i.e. the one furthest from knob 30 are moved. Hence, the selector knob 30 and the indexing shaft 24 are positioned as far to the right, as possible in FIG. 2. When other type wheels and indicating wheels are selected for movement, however, the selector knob 30, indexing shaft 24 and other parts project to the left of the body of the printing device of FIG. 2 and the label printing and applying machine, as indicated by the phantom lines in FIG. 13. Once type selection has been completed, during the subsequent label printing and applying operation, the projecting portions are liable to be undesirably bumped against the articles receiving the labels, the edges of containers of articles, display stands, work tables, etc. Accordingly, the indexing shaft 24, knob 30 or other parts may be damaged or the label applying operation may be interrupted. Further, when the label printing machine is dropped, such projecting portions are often damaged.

Referring to FIGS. 14–17 and 19–22, another preferred embodiment of the present invention is now described. Those elements and structures which are the same as or correspond in place and function to elements and structures of the first embodiment of FIGS. 1–9 are correspondingly numbered with the same reference numerals raised by 300.

Figure 16:
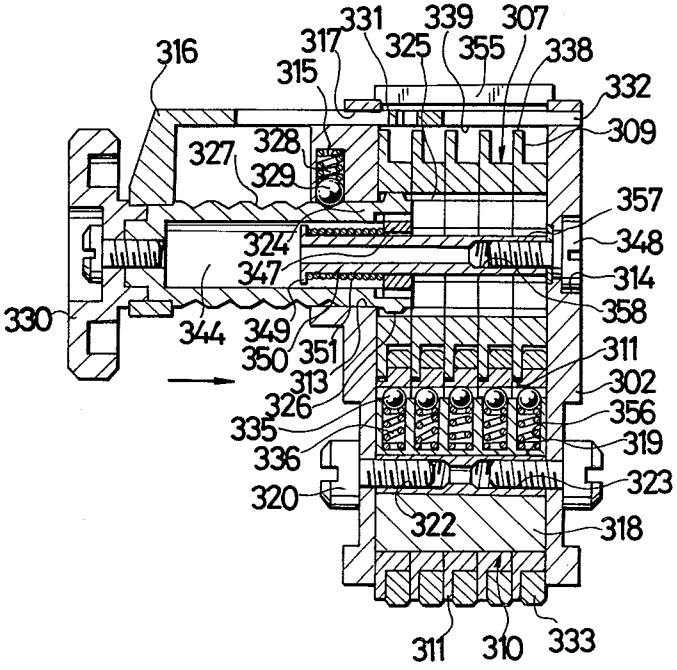
FIG. 16 is a vertical cross-sectional view similar to FIG. 15, but with the printing device in a different operative condition.
Figure 17:
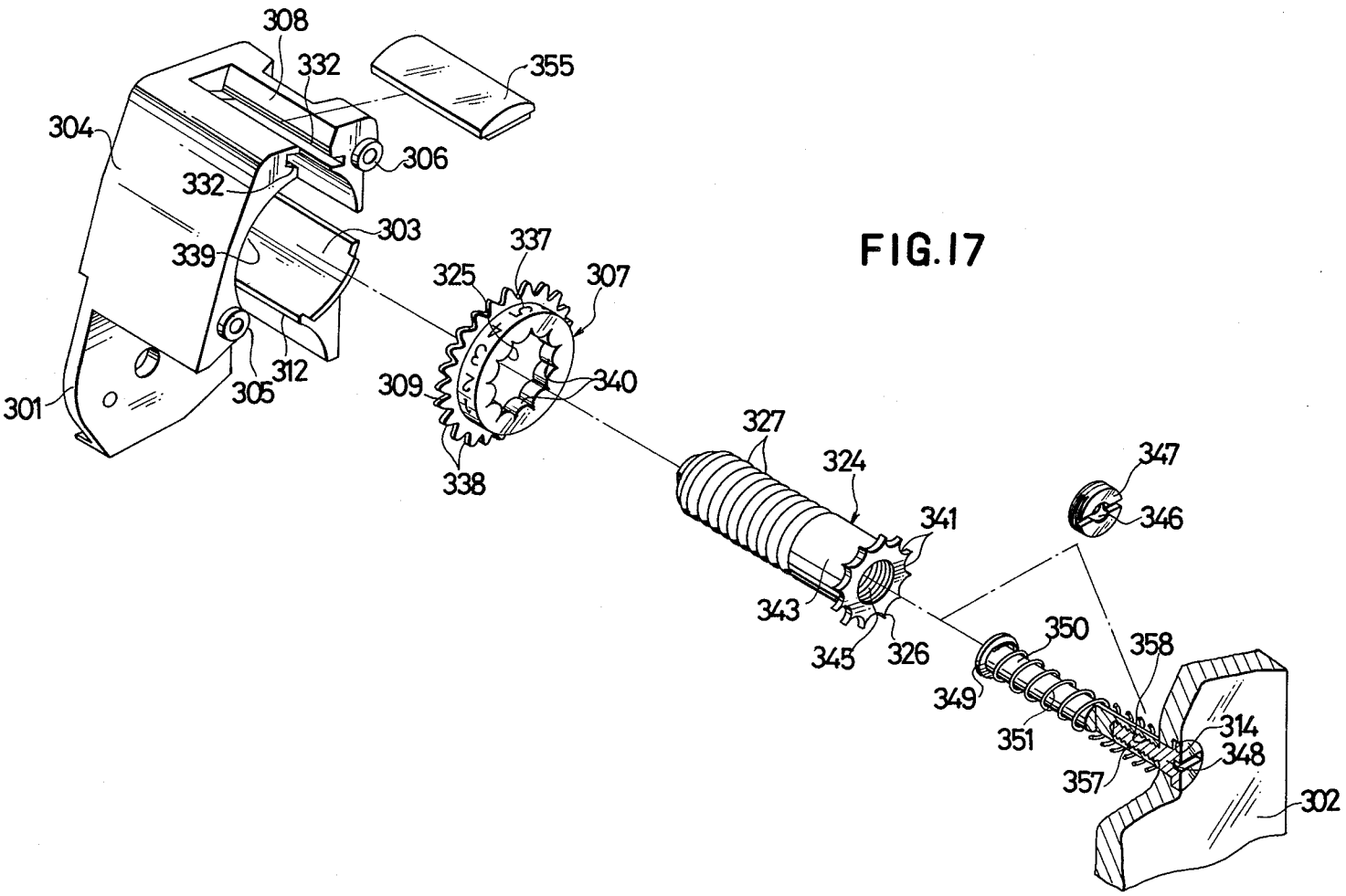
FIG. 17 is an exploded perspective view of some of the elements of the second embodiment of the printing device, namely, a side frame, an indicating wheel, an indexing shaft and means for shifting the shaft.

As shown in FIGS. 14 to 17, the printing device includes a pair of spaced apart side frames 301 and 302. The side frame 301 integrally supports on one side a frame body 304 having a circular blind hole 303 formed in it (FIG. 17). Hole 303 is defined by its inside wall 339. There are recesses (not shown) formed in the inside face of the other side frame 302 to receive the projections 305 and 306 formed on the frame body 304 and to properly orient the side frames with respect to each other. The side frame 302 is secured to the frame body 304 by means of respective set screws (not shown).

At the upper end of the blind hole 303, there is an indicating window 308, through which several rows of indicia 337 formed on the peripheral surfaces of indicating wheels 307 may be observed. Further, the indicating window 308 is provided with a lens 355 so as to facilitate the reading of indicia 337.

At the lower end of the blind hole 303, there is a large opening 312, through which the external gear teeth 309 of the indicating wheels 307 communicate with the external gear teeth 311 of type wheels 310.

A plurality of same size indicating wheels 307, each carrying visible indicia 337 that correspond to respective types on the corresponding type wheels, are arrayed side-by-side on a common axis in the blind hole 303. The indicating wheels 307 each have external, outwardly projecting gear teeth 309 with outer ends or crests 338. All the indicating wheels 307 are supported by the engagement between the tooth crests 338 of the external gear teeth 309 of indicating wheels 307 and the inside wall 339 of the blind hole 303. Therefore, the indicating wheels 307 can be rotated easily with negligible frictional resistance.

A central opening is formed in each indicating wheel 307. The opening is surrounded by and defined by gear teeth 325, which are in the illustrated form of involute curves. All central openings are of the same shape and size. By means described below, except when an indicating wheel 307 is being rotated, all of the gear teeth of all of wheels 307 are aligned axially.

A wider bearing hole 313 is bored in side frame 301 and an indexing shaft supporting and screw receiving hole 314 is bored in the other side frame 302. The holes 313 and 314 are concentric with the much wider blind hole 303. Aligned holes 322 and 323 are formed in the lower parts of the frames 301 and 302 for receiving a supporting shaft 319. Shaft 319 is secured at the holes 322 and 323 with the respective screws 320 and 321. The shaft 319 passes through and carries a large diameter supporing drum 318 for the type wheels 310.

Figure 15:
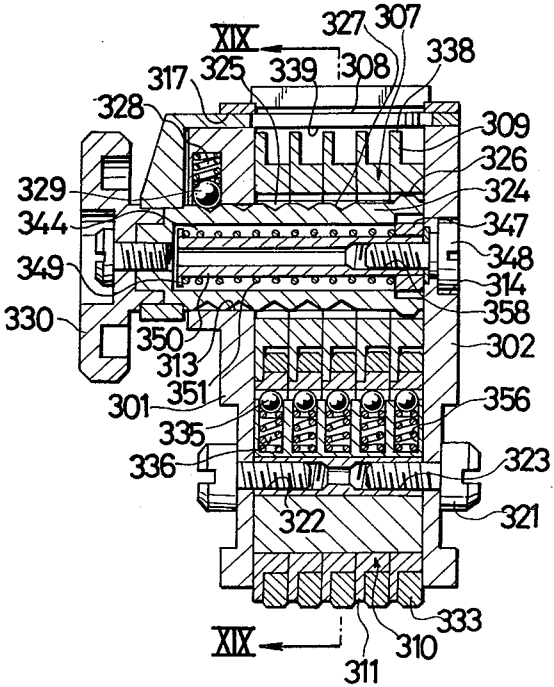
FIG. 15 is a vertical cross-sectional view of the second embodiment of the printing device taken along the line XV—XV in FIG. 19.

As shown in FIGS. 15 and 17, an indexing shaft 324 passes through and is supported by the wall of the side frame 1 surrounding bearing hole 313. The indexing shaft 324 is inserted through the central openings in the aligned indicating wheels 307. The indexing shaft 324 and the central openings through wheels 307 are shaped and sized so as to leave a clearance space 342 (FIGS. 20 and 21) between the outer surface 343 of shaft 324 and the internal gear teeth 325 of indicating wheels 307.

Along the middle portion of the indexing shaft 324, a plurality of axially spaced annular indexing grooves 327 are formed. They are spaced apart the same distance as the indicating wheels 307.

As shown in FIGS. 15, 16, 17, 20 and 22, a toothed pinion 326 is formed at the free end of the indexing shaft 324. The involute curves 341 of the teeth of the pinion 326 are correspondingly shaped to and are positioned in the corresponding involute curves 340 of the internal gear teeth 325 of an indicating wheel 307. The shaping of pinion 326 and all gear teeth 325 is such as to leave the small space 342 (FIG. 20) between the gear teeth 325, 341 before the gear teeth 325, 341 are engaged together.

The side frame 301 has a small blind hole 315 which is perpendicular to and extends away from the bearing hole 313. A steel ball 329 is held in the blind hole 315. Ball 329 is urged out of hole 315 by a helical spring 328 behind the ball. The shaft 324 is axially shiftable through the indicating wheels 307. The steel ball 329 is brought into engagement with the indexing groove 327 on the indexing shaft 324 that is then beneath hole 315. By appropriate placement of hole 315 with respect to grooves 327, axial positioning of the pinion 326 wholly inside only one indicating wheel at a time is attained. Square shaped apertures 317 are formed in the side frames 301 and 302 for receiving an indicating member 316. The indicating member 316 is rotatably supported on and axially affixed on the end of the indexing shaft 324 which projects from the side frame 301. Thus, the indicating member 316 shifts axially with the shaft 324, but the shaft is able to rotate while the member 316 does not rotate. The indicating member passes through and is thus restrained from rotation by the apertures 317 in the side frame 301.

At the outside of the indicating member 316, the indexing shaft 324 is provided with a selector knob 330. When the selector knob 330 is moved in the axial direction of the indexing shaft 324, the shaft is moved together with the indicating member 316 so as to move the pinion 336 into a selected indicating wheel 307. The shaft 324 is then rotated about its axis by the selector knob 330 until a selected indicium on the wheel 307 appears at the window 308.

One side edge of the indicating member 316 is provided with an arrow 331 that is axially aligned with the pinion 326. Arrow 331 points to the indicating wheel 307 whose indicia are to be selected and in which the pinion 326 is engageable with the internal gear teeth 325. The indicating member 316 is guided by the grooves 332 of the frame body 304 and thus it is slidable across the indicating window 308.

There is a type wheel 310 associated with each indicating wheel 307. Each type wheel is provided on its periphery with a series of types 333 to be printed. Alternatively, a stamp belt carrying the series of types to be printed is wrapped about the type wheel and its corresponding indicating wheel or about the type wheel alone. Each type wheel has an enlarged diameter opening through its center, which is defined by a toothed or plural recessed side wall having recesses 334 in it. The number of recesses 334 corresponds to the number of imprinting types 333 on type wheel 310, and each recess 334 is so placed with respect to its corresponding type 333 as to assure each type will only stop with precision at its print position.

As shown in FIG. 15, adjacent to the series of types on each type wheel 310 are the external peripheral gear teeth 311, which are shaped, spaced and positioned to be in continuous meshing engagement with the external gear teeth 309, 338 of the corresponding indicating wheel. The opening 312 at the bottom of the side frame 304 and side wall 339 provides access for this engagement. Rotation of an indicating wheel 307 causes corresponding rotation of the respective type wheel 310.

Figure 20:
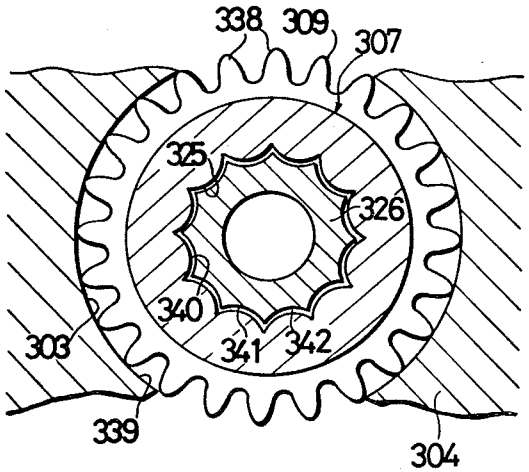
FIG. 20 is an enlarged cross-sectional view of a fragment of the printing device in one operative condition.

There is a detent means for properly positioning each type wheel only at print positions. On the periphery of supporting drum 318 is defined a series of blind holes 356, each placed to be within a respective type wheel 310. In each blind hole 356 is a steel ball 335 which is urged out of the hole by the helical spring 336 and into engagement with a recess 334. The rotational positioning of each type wheel 310 so that a type on or supported thereby is securely in a print position is accomplished by the engagement of one of the steel balls 335 with one of the recesses 334 of the type wheel 310. It is apparent that the positions of the recesses 334 of a type wheel with respect to its types 333 and with respect to its ball 335 are selected so that that wheel is positioned with a type in the print position. Concurrently with this positioning of type wheel 310, the involute curves 340 of the internal gear teeth 325 of the corresponding indicating wheel 307 are aligned in parallel to the axis of the indexing shaft 324 and are aligned with each other along the axis of shaft 324. Thus, the same shaped space 342 is formed between the involute curves 341 of the pinion 326 and the interior of every wheel 307, as shown in FIG. 20. The orientations of all of the indicating wheels are related such that the involute curves 340 of internal gear teeth 325 of all indicating wheels 307 are all aligned, creating a common, aligned, axially elongated free space 342. Because of the existence of the aligned free spaces 342 in wheels 307, the pinion 326 can be easily moved through the aligned spaces 342 along the axis of the indexing shaft 324 through axial shifting of that shaft with almost no frictional resistance. Axial shifting of shaft 324 is deterred only by the resistance to its motion caused by the spring actuated ball 329 engaging an indexing groove 327 and the force of spring 328 having to be overcome. The pinion 326 can be accurately axially shifted to be in mesh with the internal gear teeth 325 of only one indicating wheel 307 because of the certain positioning resulting from the steel ball 329 being in a respective indexing groove 327.

As shown in FIGS. 15–17, indexing shaft 324 is hollow and tubular in form and it has an internal bore 344. In the open end portion or right hand end of the bore 344, screw threads 345 are formed. A supporting member 347 having a through hole 346 is engaged with and screwed into the threads 345. A screw hole 314 is formed in the side frame 302. A screw 348 having screw threads 357 formed on its shank is fixed in the screw hole 314. There is a tubular rod 350 fitted in the hollow internal bore 344 of the indexing shaft 324. Rod 350 has internal threads 358 at one end to matingly receive threads 357. Rod 350 has a flange 349 at its other end. Rod 350 is inserted into the through hole 346 of the supporting member 347. There is a compression spring 351 coiled around the rod 350 and extending between the flange 349 of the rod 350 and the supporting member 347. Spring 351 normally biases shaft 324 into the printing device.

To select a desired type on a particular type wheel, knob 330 is axially shifted until the arrow 331 of the indicating member 316 points to that indicating wheel which is then in engagement with the type wheel to be rotated. The corresponding pinion 326 is thereby shifted into the internal gear teeth 325 of the indicating wheel 307 to be rotated. Such shifting will, of course, compress the spring 351. The involute curves 341 around the pinion 326 and the involute curves 340 of internal gear teeth 325 of the indicating wheel 307 still have not contacted each other, leaving the space 342 (FIG. 20).

Figure 22:
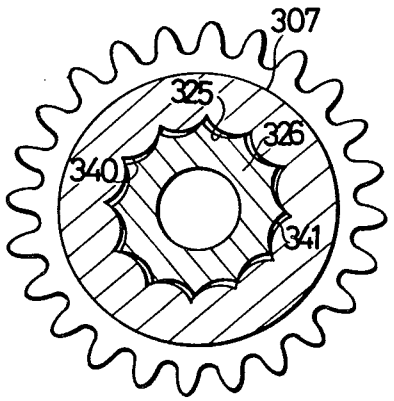
FIG. 22 is an enlarged cross-sectional view of a fragment of FIG. 20 showing the elements in a different operative condition.

Next, as shown in FIG. 22, the selector knob 330 is rotated. This causes the pinion to close the space 342 to engage the curves 340 of gear teeth 325 and to rotate the selected indicating wheel 307, which is in engagement with the gear teeth of the pinion 326, until a desired indicium 337 appears at the indicating window 308. The indicia 337 are enlarged by the lens 355 so that they are easily read. Because of the connection between the selected indicating wheel 307 and its type wheel 310, the type 333 on the type wheel 310, which corresponds to the viewable indicium at window 308, is moved to the print position.

Figure 19:
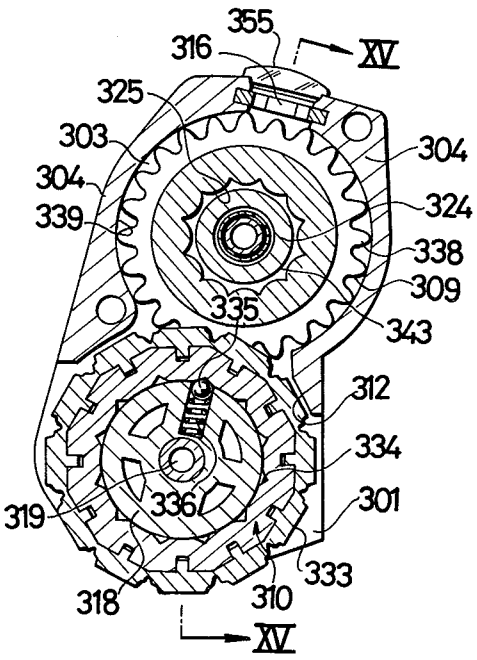
FIG. 19 is a vertical cross-sectional view of the second embodiment of the printing head taken along the line XIX—XIX in FIG. 15.

In the foregoing type selection operation, because the indicating wheels 307 are held within the blind hole 303 and wheels 307 are supported by the contact between the tooth crests 338 of external gear teeth 309 of the indicating wheels 307 and the inside wall 339 of the hole 303, as shown in FIGS. 15, 19 and 20, the selected indicating wheel 307 can be rotated without difficulty. Further, because the steel ball 335 is urged into all of the recesses 334 of the type wheel 310, in turn, the types 333 on the type wheel 310 can be stopped at their proper position. With this action, the indicating wheel 307 is also stopped at its proper position.

After the selection of types 333 has been completed, the spring 351 is generally compressed between the supporting member 347 and the flange 349 of the rod 350 and is energized. This is shown in FIG. 16 where indexing shaft 324 is moved to the left, relative to the rod 350 which is fixed to the side frame 302. In the case when the pinion 326 is positioned in the innermost indicating wheel 307 relative to the knob 330, as shown in FIG. 15, only then is spring 351 not compressed. With the spring 351 compressed, when an operator releases the selector knob 330, the supporting member 347 is pushed toward the side frame 302 by the spring 351. The indexing shaft 324, together with the selector knob 330 and the indicating member 316, are slid into the body of printing device in the direction of the arrow in FIG. 16. With this automatic action, the printing device resumes its former compact state with the knob 330 and shaft 324 out of the path of undesired contact, as shown in FIG. 15.

The returning inward motion of the indexing shaft 324 is exerted against the resistance of the steel ball 329 and the spring 328. Therefore, the force of the spring 351 that is exerted or the indexing shaft 324 must be larger than the resistance to motion caused by the spring 328.

Figure 18:
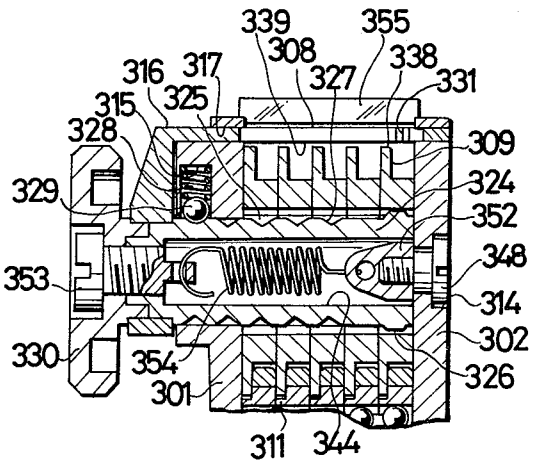
FIG. 18 is a vertical cross-sectional view of part of a modified version of the second embodiment of the printing device of the invention.
Figure 21:
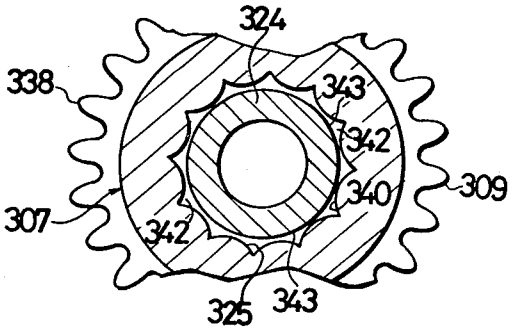
FIG. 21 is an enlarged cross-sectional view of the upper main part of FIG. 19.

Further, the spring mechanism of this invention is not restricted to the above-described embodiment. As shown in the modified version of the second embodiment of FIG. 18, a spring support member 352 is attached to the screw 348, and a tension spring 354 is stretched between the support member 352 and a screw 353 that secures the selector knob 330 to the indexing shaft 324. Through the tensioning of the spring 354, the same object of the second embodiment of the invention can also be attained.

By the mechanisms disclosed just above, the selector knob, indexing shaft and other parts that project from the side frame can be automatically returned into the body of the printing device when the operator releases the selector knob after the completion of type selection.

Furthermore, the printing device which can be provided with the spring mechanism of the invention is not restricted to the above embodiment and it should be noted that various kinds of printing devices can be provided with the spring mechanism just described.

In accordance with the foregoing, the present invention has the following benefits:

(a) The frame body of the printing device has a blind hole that is formed in one of the side frames of the body. The indicating wheels are supported in the blind hole, such that the tooth crests of the indicating wheels are in point contact with the inside wall of the hole. The frictional resistance to rotation of the indicating wheels is low and the type selector knob and the indexing shaft in the indicating wheels can be rotated without difficulty, thereby facilitating the selection of desired types.

(b) Because the indicating wheels are supported by their external crests, the indexing shaft passing through those wheels needs no additional support besides those wheels and bearings in the side frames. No sleeve need be employed for surrounding and supporting the indexing shaft. Without the necessity for the additional thickness of a sleeve, the shaft can be made relatively thick, whereby breaking of the indexing shaft can be prevented.

(c) A clear space is left between the involute curves of the pinion and those of the internal gear teeth of indicating wheels. Therefore, the indexing shaft carried by one of side frames can be axially slid with almost no resistance and the selection of indicating wheel can be carried out easily.

(d) An indexing shaft surrounding sleeve of the prior art needs grooves to permit pinion teeth to project through to the indicating wheels to be rotated. But with no sleeve surrounding the shaft, no elongated grooves and projections of a sleeve are necessary. Therefore, the number of teeth on the pinion can be increased. Also, breaking of the mechanism can be prevented.

(e) The side frame on one side of the printing device and the frame body can be formed together as one unit and an indexing shaft made of synthetic plastics can be used. The parts are easily made and assembled, which facilitates mass production.

(f) The indexing shaft, selector knob and indicating member are not damaged and the label applying operation can be smoothly and efficiently performed.

(g) The extra step of pushing the selector knob toward the body of the printing device can be eliminated.

(h) The label applying operation can be performed even where only a narrow width working area or space for the labeling machine is available, since the selector knob and indexing shaft are out of the way.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. A printing device for a labeling machine, or the like, comprising:

a first array of wheels arranged side-by-side on a first common axis; a frame for supporting said first array of wheels; said wheels of said first array each having an engageable periphery;

a second array of type wheels arranged side by side on a second common axis, and all said type wheels also being supported on said frame; each said type wheel being provided with a respective set of imprintable types; each said type wheel having a periphery that is engageable with said periphery of a wheel of said first array such that rotation of a said wheel of said first array rotates the respective said type wheel; each said set of types being attached to a respective said type wheel to be moved to place a different said type at a print position by means of rotation of the corresponding said type wheel;

all said wheels of said first array having a respective central opening therethrough, and each said central opening having a respective first cross-section and being defined by a respective profiled surface having a respective first profile; said central openings being on said common axis; all said first profiled surfaces being identically shaped and sized;

an indexing shaft extending into said frame and adapted and shaped to pass through and be slidable through all said central openings; a pinion on said shaft; said pinion having a second cross-section that is smaller than all said respective first cross-sections; said pinion having a second profile that is adapted to engage any of said respective first profiled surfaces at a first rotative orientation of said pinion and to be completely disengaged from that said first profiled surface at a different, second rotative orientation of said pinion, and such that at said second orientation of said pinion, there is a clearance space between said pinion and said first profiled surface of a said wheel in which said pinion is then located;

wheel rotative position establishing means for establishing discrete rotative positions for every said wheel of said first array such that at every established discrete position of every said wheel of said first array, all said profiled surfaces are identically aligned, whereby said pinion at its said second orientation may freely pass through all said wheel central openings with clearance space;

said frame comprising a side frame extending axially the width of said first array of wheels, said side frame having a blind hole therein defined by a side wall and extending axially of said wheels; said first array of wheels all sitting in and being guided for rotation by said side wall of said blind hole; said blind hole side wall and said periphery of all said first array wheels being respectively profiled such that said first array wheels are supported by their said peripheries in said blind hole for rotation around their said axis;

an opening in said blind hole side wall for enabling engagement between each said first array wheel and its respective said type wheel.

2. The printing device of claim 1, further comprising said first array wheel exterior peripheries each being defined by first gear teeth; said first teeth engaging said blind hole side wall;

each said type wheel periphery having second gear teeth provided on and extending around the respective said type wheel; said second gear teeth of each said type wheel meshing with said first gear teeth of the respective said wheel of said first array.

3. A printing device for a labeling machine, or the like, comprising:

a first array of wheels arranged side-by-side on a first common axis; a frame for supporting said first array of wheels; said wheels of said first array each having an engageable periphery;

a second array of type wheels arranged side by side on a second common axis, and all said type wheels also being supported on said frame; each said type wheel being provided with a respective set of imprintable types; each said type wheel having a periphery that is engageable with said periphery of a wheel of said first array such that rotation of a said wheel of said first array rotates the respective said type wheel; each said set of types being attached to a respective said type wheel to be moved to place a different said type at a print position by means of rotation of the corresponding said type wheel;

all said wheels of said first array having a respective central opening therethrough, and each said central opening having a respective first cross-section and being defined by a respective profiled surface having a respective first profile; said central openings being on said common axis;

an indexing shaft extending into said frame and adapted and shaped to pass through and be slidable through all said central openings; a pinion on said shaft; said pinion having a second cross-section that is smaller than all said respective first cross-sections; said pinion having a second profile that is adapted to engage any of said respective first profiled surfaces at a first rotative orientation of said pinion and to be completely disengaged from that said first profiled surface at a different, second rotative orientation of said pinion, and such that at said second orientation of said pinion, there is a clearance space between said pinion and said first profiled surface of a said wheel in which said pinion is then located;

said frame comprising a side frame extending axially the width of said first array of wheels, said side frame having a blind hole therein defined by a side wall and extending axially of said wheels; said first array of wheels all sitting in and being guided for rotation by said side wall of said blind hole; said blind hole side wall and said periphery of all said first array wheels being respectively profiled such that said first array wheels are supported by their said peripheries in said blind hole for rotation around their said axis;

an opening in said blind hole side wall for enabling engagement between each said first array wheel and its respective said type wheel.

4. The printing device of claim 3, wherein said first array wheel exterior peripheries are each defined by gear teeth, which said teeth engage said blind hole side wall;

each said type wheel periphery having second gear teeth provided on and extending around the respective said type wheel; said second gear teeth of each said type wheel meshing with said first gear teeth of the respective said wheel of said first array.

5. The printing device of claim 3, further comprising a second opening in said blind hole wall and being located away from the first said opening and the engagement between a said first array wheel and its respective said type wheel; each said first array wheel carrying indicia on its surface, with each said indicium corresponding to a said type on the respective said type wheel; each said type and its said first array wheel being so arranged and oriented with respect to each other that the said indicium of a said first array wheel that is viewable at said second opening corresponds to the said type on said type wheel that is then at a print position.

6. A printing device for a labeling machine, or the like, comprising:

an array of wheels arranged side-by-side on a common axis; a frame for supporting said array of wheels;

a respective set of types comprised of a plurality of types and connected with each said wheel of said array such that rotation of a said wheel moves a different one of the respective said types to a print position;

all said wheels of said array having a respective central opening therethrough, and each said central opening having a respective first cross-section and being defined by a respective profiled surface having a respective first profile; said central openings being on said common axis;

an indexing shaft extending into said frame and adapted and shaped to pass through and be slidable through all said central openings; a pinion on said shaft; said pinion being shaped to be engageable with any of said profiled surfaces of any of said wheels upon rotation of said shaft about said axis with said pinion in the respective said wheel to be rotated; said pinion being shaped to be able to pass through all of said central openings;

biasing means connected to said indexing shaft for normally biasing it to move into said frame and to move said pinion through and across said central openings of all said wheels as said indexing shaft moves into said frame.

7. The printing device of claim 6 wherein said biasing means is so placed and being adapted so as to be charged when said indexing shaft is drawn out of said frame and to be discharged as said indexing shaft moves into said frame.

8. The printing device of claim 7, wherein said biasing means extends between said frame and said indexing shaft.

9. The printing device of claim 8, wherein said indexing shaft is hollow; a rod located inside said hollow indexing shaft and fixed to said frame; said biasing means comprising a spring wrapped around and guided by said rod; said spring engaging said frame by engaging said rod fixed to said frame.

10. The printing device of claim 8, further comprising detent means on said indexing shaft and cooperating detent means on said frame, both so located as to cause said indexing shaft to be axially shiftable such that said indexing shaft may be halted in its axial shifting only with said pinion wholly inside one said central opening;

said biasing means for said indexing shaft exerting greater force upon said shaft than the cooperating said detent means, whereby upon release of said indexing shaft, said indexing shaft is moved by said biasing means into said frame and past said cooperating detent means on said frame.

11. The printing device of claim 8, wherein said pinion has a second cross-section that is smaller than all said respective first cross-sections; said pinion having a second profile that is adapted to engage any of said respective first profiled surfaces at a first rotative orientation of said pinion and to be completely disengaged from that said first profiled surface at a different, second rotative orientation of said pinion, and such that at said second orientation of said pinion, there is a clearance space between said pinion and said first profiled surface of a said wheel in which said pinion is then located.

12. The printing device of claim 11, wherein all said first profiled surfaces are identically shaped and sized;

wheel rotative position establishing means for establishing discrete rotative positions for every said wheel such that at every established discrete position of every said wheel, all said profiled surfaces are identically aligned, whereby said pinion at its said second orientation may freely pass through all said wheel central openings with clearance space.

13. The printing device of claim 12, wherein said frame comprises a side frame extending axially the width of said array of said wheels, said side frame having a blind hole therein defined by a side wall and extending axially of said wheels; said wheels all sitting in and being guided for rotation by said side wall of said blind hole; all said wheels having an exterior periphery; said blind hole side wall and said exterior periphery of all said wheels being respectively profiled such that said wheels are supported in said blind hole for rotation around their said axis.

14. The printing device of claim 13, further comprising said wheel exterior peripheries each being defined by first gear teeth; said first teeth engaging said blind hole side wall;

said respective sets of types comprise a second array of type wheels arranged side by side on a second common axis, and all of said type wheels also being supported on said frame; a respective said type wheel being provided for each said set of types; each said type wheel having second gear teeth provided on and extending around the respective said type wheels; said second gear teeth of each said type wheel meshing with said first gear teeth of the respective said wheel such that rotation of a said wheel of said first array rotates the respective said type wheel; each said set of types being attached to a respective said type wheel to be moved to place a different said type at a print position by means of rotation of the corresponding said type wheel;

an opening in said blind hole side wall for enabling communication between said wheel and its respective said type wheel.

* * * * *